US006805644B1

(12) United States Patent
Moriyama et al.

(10) Patent No.: US 6,805,644 B1
(45) Date of Patent: Oct. 19, 2004

(54) THREE-PIECE SOLID GOLF BALL

(75) Inventors: Keiji Moriyama, Akashi (JP); Kazunari Yoshida, Kasai (JP); Satoshi Iwami, Akashi (JP); Keiji Ohama, Akashi (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/549,565

(22) Filed: Apr. 14, 2000

(30) Foreign Application Priority Data

Apr. 14, 1999 (JP) ..... 11-106228

(51) Int. Cl.[7] ..... A63B 37/04; A63B 37/06; A63B 37/12; A63B 37/14

(52) U.S. Cl. ..... 473/377; 473/378

(58) Field of Search ..... 473/351, 353, 473/356, 357, 359, 361, 362, 363, 365, 367, 370, 373, 374, 378

(56) References Cited

U.S. PATENT DOCUMENTS

| | | | | |
|---|---|---|---|---|
| 4,919,434 A | | 4/1990 | Saito | |
| 5,439,227 A | | 8/1995 | Egashira et al. | |
| 5,553,852 A | | 9/1996 | Higuchi et al. | |
| 5,730,663 A | * | 3/1998 | Tanaka et al. | 473/373 |
| 5,782,707 A | * | 7/1998 | Yamagishi et al. | 473/374 |
| 5,820,487 A | * | 10/1998 | Nakamura et al. | 473/374 |
| 5,830,085 A | * | 11/1998 | Higuchi et al. | 473/373 |
| 5,876,294 A | * | 3/1999 | Yamagishi et al. | 473/374 |

FOREIGN PATENT DOCUMENTS

| | | |
|---|---|---|
| GB | 2302330 A | 1/1997 |
| JP | 7-24085 | 1/1995 |
| JP | 7-8301 | 2/1995 |
| JP | 2570587 | 10/1996 |
| JP | 9-10357 | 1/1997 |
| JP | 9-313643 | 12/1997 |

OTHER PUBLICATIONS

Farrally, M. R., et al. Science and GOlf III:Proceeding of the 1998 World Scientific Congress of Golf. Illinios: Human Kinetics, copyright 1999, p. 483.*

* cited by examiner

*Primary Examiner*—Sebastiano Passaniti
*Assistant Examiner*—Alvin A. Hunter, Jr.
(74) *Attorney, Agent, or Firm*—Birch, Stewart, Kolasch & Birch, LLP

(57) ABSTRACT

The present invention provides a three-piece solid golf ball having long flight distance, by accomplishing high launch angle and low spin amount immediately after hitting, while maintaining soft and good shot feel when hitting at low head speed. The present invention relates to a three-piece solid golf ball comprising a center, an intermediate layer formed on the center, and an outer layer covering the intermediate layer, wherein the center has a central point hardness in JIS-C hardness of 55 to 75 and a surface hardness in JIS-C hardness of 65 to 85, the surface hardness is higher than the central point hardness by 10 to 20, a JIS-C hardness of the intermediate layer is higher than the surface hardness of the center by 10 to 20, and a JIS-C hardness of the outer layer is higher than the hardness of the intermediate layer by 5 to 15.

10 Claims, 1 Drawing Sheet

THREE-PIECE SOLID GOLF BALL

FIELD OF THE INVENTION

The present invention relates to a e-piece solid golf ball. More particularly, it relates to a three-piece solid golf ball having long flight distance, by accomplishing high launch angle and low spin amount immediately after hitting, while maintaining soft and good shot feel when hitting at a low head speed.

BACKGROUND OF THE INVENTION

Many types of golf balls are commercially selling, but they are typically classified into solid golf balls such as two-piece golf ball, three-piece golf ball and the like, and thread wound golf balls. The solid golf balls generally occupy the greater part of the golf ball market, because they inherently have longer flight distance than the thread wound golf balls and have been improved to have soft and good shot feel at the time of hitting as good as the thread wound golf ball. The three-piece golf ball, when compared with the two-piece golf ball, has better shot feel while maintaining excellent flight performance, because the three-piece golf ball can vary hardness distribution.

The three-piece solid golf balls are those placing an intermediate layer between the core and the cover layer constituting the two-piece solid golf ball, and have been described in Japanese Patent Kokoku Publication No. 8301/1995; Japanese Patent Kokai Publication Nos. 24085/1995, 10357/1997 and 313643/1997; and Japanese Patent Nos. 2570587 and 2658811. In these golf balls, it has been accomplished to improve the shot feel at the time of hitting, while maintaining excellent flight performance, by using thermoplastic resin, such as ionomer resin, thermoplastic elastomer or mixtures thereof, for the intermediate layer, to adjust a hardness of the core, intermediate layer and cover and a hardness distribution thereof to a proper range.

However, in the golf balls, there has been problem that the shot feel is hard and poor when hitting at a low head speed by a driver or an iron club, and the problem has never been considered.

OBJECTS OF THE INVENTION

A main object of the present invention is to provide a three-piece solid golf ball having long flight distance, by accomplishing high launch angle and low spin amount immediately after hitting, while maintaining soft and good shot feel when hitting at a low head speed by a driver or an iron club.

According to the present invention, the object described above has been accomplished by placing an intermediate layer between a center and an outer layer to make a three-piece solid golf ball, and adjusting a hardness and hardness distribution of the center, a hardness difference between the center and the intermediate layer and a hardness difference between the intermediate layer and the outer layer to specified ranges, thereby providing a three-piece solid golf ball having long flight distance, by accomplishing high launch angle and low spin amount immediately after hitting, while maintaining soft and good shot feel when hitting at low head speed by a driver or an iron club.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
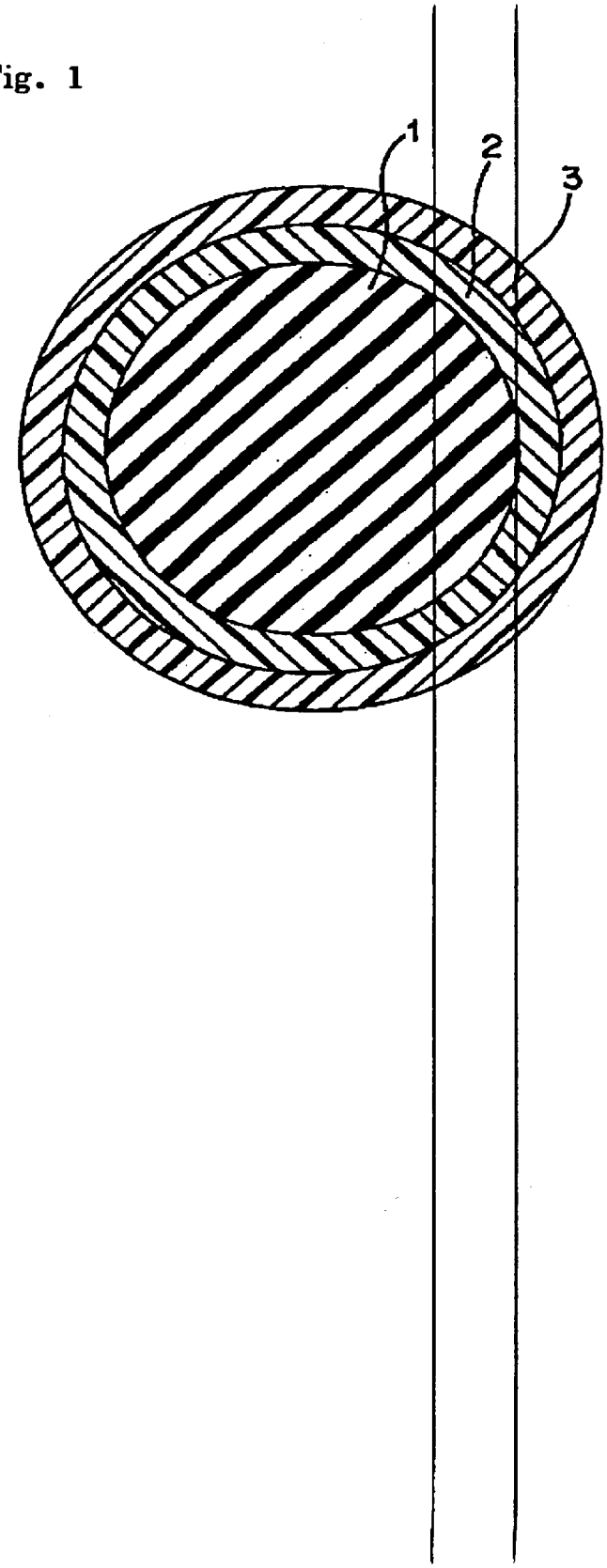
FIG. 1 is a schematic cross section illustrating one embodiment of the golf ball of the present invention.

The present invention provides a three-piece solid golf ball comprising a center, an intermediate layer formed on the center, and an outer layer covering the intermediate layer, wherein the center has a central point hardness in JIS-C hardness of 55 to 75 and a surface hardness in JIS-C hardness of 65 to 85, the surface hardness is higher than the central point hardness by 10 to 20, a JIS-C hardness of the intermediate layer is higher than the surface hardness of the center by 10 to 20, and a JIS-C hardness of the outer layer is higher than the hardness of the intermediate layer by 5 to 15.

In order to practice the present invention suitably, it is desired that a specific gravity of the intermediate layer be higher than that of the center by 0.05 to 0.2, the center be mainly formed from ionomer resin, and the intermediate layer center and the outer layer each have a thickness of 1.0 to 2.0 mm.

DETAILED DESCRIPTION OF THE INVENTION

The three-piece solid golf ball of the present invention will be explained with reference to the accompanying drawing in detail. FIG. 1 is a schematic cross section illustrating one embodiment of the three-piece solid golf ball of the present invention. As shown in FIG. 1, the golf ball of the present invention comprises a center 1 and an intermediate layer 2 formed on the center 1, and an outer layer 3 covering the intermediate layer 2. The center 1 is formed from a rubber composition comprising a base rubber, a co-crosslinking agent, an organic peroxide, a filler and the like.

The base rubber used in the present invention may be natural rubber and/or synthetic rubber, which have been conventionally used for solid golf balls. Preferred is high-cis polybutadiene rubber containing not less than 40%, preferably not less than 80% of a cis-1, 4 bond. The high-cis polybutadiene rubber may be mixed with natural rubber, polyisoprene rubber, styrene-butadiene rubber, ethylene-propylene-diene rubber (EPDM) and the like.

The co-crosslinking agent can be a metal salt of $\alpha\beta$-unsaturated carboxylic acid, including mono or divalent metal salts, such as zinc or magnesium salts of $\alpha\beta$-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent in the rubber composition is from 20 to 30 parts by weight, preferably from 24 to 28 parts by weight, based on 100 parts by weight of the base rubber when the amount of the co-crosslinking agent is smaller than 20 parts by weight, the center is too soft, and the rebound characteristics are degraded, which reduces flight distance. On the other hand, when the amount of the co-crosslinking agent is larger than 30 parts by weight, the center is too hard, and the shot feel is hard and poor.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.1 to 3.0 parts by weight, preferably 0.1 to 1.0 parts by weight, based on 100 parts by weight of the base rubber. When the amount of the organic peroxide is smaller than 0.1 parts by weight, the center is too soft, and the rebound characteristics are degraded, which reduces flight distance. On the other hand, when the amount of the organic peroxide is larger than 3.0 parts by weight, the center is too hard, and the shot feel is poor.

The filler used for the center 1 of the present invention, which can be typically used for the core of golf balls, includes for example, inorganic filler (such as zinc oxide, barium sulfate, calcium carbonate and the like), high specific gravity metal powder filler (such as tungsten powder, molybdenum powder and the like), and the mixture thereof.

The rubber composition for the center 1 of the golf ball of the present invention can contain other components, which have been conventionally used for preparing the core of solid golf balls, such as antioxidant or peptizing agent.

The center 1 is obtained by mixing the above rubber composition, and then vulcanizing and press-molding the mixture in a mold. It is required that the center 1 of the golf ball of the present invention have a central point hardness in JIS-C hardness of 55 to 75, preferably 55 to 65, more preferably 55 to 64, and a surface hardness in JIS-C hardness of 65 to 85, preferably 70 to 75, more preferably 72 to 75. When the central point hardness is lower than 55, the center is too soft, and the deformation amount at the time of hitting is too large, which reduces the flight distance, and the shot feel is heavy and poor. On the other hand, when the central point hardness is higher than 75, the deformation amount at the time of hitting is too small and the launch angle is small, which reduces the flight distance. When the surface hardness is lower than 65, the deformation amount at the time of hitting is too small and the launch angle is small, which reduces the flight distance. On the other hand, when the surface hardness is higher than 85, the shot feel is hard and poor. The term "central point hardness of the center" as used herein is determined by cutting the core into two equal parts and then measuring a hardness at the central point of the section.

It is required that the surface hardness in JIS-C hardness be higher than the central point hardness in JIS-C hardness by 10 to 20, preferably 10 to 18, more preferably 12 to 18, in the center 1 of the golf ball of the present invention. When the difference between the surface hardness and the central point hardness is larger than 20, the deformation amount at the time of hitting is too large, and the rebound characteristics are not sufficiently obtained and the shot feel is heavy and poor. On the other hand, when the hardness difference is smaller than 10, the launch angle is small, which reduces the flight distance, and the shot feel is hard and poor. On the other hand, when the hardness difference is smaller than 10, the launch angle is small, which reduces the flight distance, and the shot feel is hard and poor.

The center 1 of the golf ball of the present invention may have a specific gravity of 1.05 to 1.25, preferably 1.10 to 1.25. When the specific gravity is smaller than 1.05, it is required to increase the specific gravity of the intermediate layer in order to impart the golf ball a desired weight, and the amount of filler in the intermediate layer is large, which reduces the rebound characteristics. On the other hand, when the specific gravity is larger than 1.25, the amount of the filler is large and the rubber content in the center composition is small, which degrades the rebound characteristics of the resulting golf ball.

It is desired that the center 1 of the golf ball of the present invention have a diameter of 34.5 to 38.5 mm, preferably 36.0 to 37.0 mm. When the diameter of the center 1 is smaller than 34.5 mm, the technical effect of heightening the rebound characteristics accomplished by the presence of the center is not sufficiently obtained. On the other hand, when the diameter is larger than 38.5 mm, the thickness of the intermediate layer is too thin, and the technical effects accomplished by the presence of the intermediate layer are not sufficiently obtained. The intermediate layer 2 is then formed on the center 1.

It is preferable that the intermediate layer 2 of the present invention is mainly formed ionomer resin. The ionomer resin may be a copolymer of $\alpha$-olefin and $\alpha$, $\beta$-unsaturated carboxylic acid having 3 to 8 carbon atoms, of which a portion of carboxylic acid groups is neutralized with metal ion. Examples of the $\alpha$-olefins in the ionomer preferably include ethylene, propylene and the like. Examples of the $\alpha\beta$-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Himilan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Du Pont Co., include Surlyn 9945, Surlyn 8945, Surlyn AD8511, Surlyn AD8512 and the like. Examples of the ionomer resins, which are commercially available from Exxon Chemical Co., include Iotek 7010, Iotek 8000 and the like. These ionomer resins may be used alone or in combination.

As the materials suitably used in the intermediate layer 2 of the present invention, the above ionomer resin may be used alone, but the ionomer resin may be used in combination with at least one of thermoplastic elastomer, diene block copolymer and the like. The thermoplastic elastomer is not limited, but includes ionomer resin, polyurethane thermoplastic elastomer, polyamide thermoplastic elastomer, polyester thermoplastic elastomer, thermoplastic elastomer having terminal OH groups and the like.

Examples of the thermoplastic elastomers include polyurethane elastomer, which is commercially available from Takeda Verdishe Co., Ltd. under the trade name of "Elastoran" (such as "Elastoran ET880"); polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 10 to 50 parts by weight, preferably 20 to 40 parts by weight, based on 100 parts by weight of the base resin for the intermediate layer. When the amount is smaller than 10 parts by weight, the technical effect of improving the shot feel at the time of hitting accomplished by using them can not be sufficiently obtained. On the other hand, when the amount is larger than 50 parts by weight, the intermediate layer is too soft and the rebound characteristics are degraded, or the compatibility with the ionomer resin is degraded and the durability is degrade.

The composition of the intermediate layer used in the present invention may optionally contain fillers and the like, in addition to the resin component as main component. Examples of fillers include inorganic filler (such as zinc oxide, barium sulfate, calcium carbonate and the like), high specific gravity metal powder filler (such as tungsten powder, molybdenum powder and the like), and the mixture thereof.

A method of forming the intermediate layer 2 of the present invention is not specifically limited, but may be a well-known method, which has been conventionally used for forming golf ball cover. For example, there can be used a method comprising molding the intermediate layer composition into a semi-spherical half-shell, covering the center with the two half-shells, followed by pressure molding, or a method comprising injection molding the intermediate layer composition directly on the center to cover it.

In the golf ball of the present invention, it is required that the JIS-C hardness of the intermediate layer 2 be lower than the surface hardness of the center 1 by 10 to 20, preferably 10 to 18, more preferably 14 to 18. When the hardness difference is lower than 10, the launch angle is small, which reduces the flight distance. On the other hand, when the hardness difference is larger than 20, the deformation amount at the time of hitting the golf ball of the intermediate layer is smaller than that of the center, and the durability is degraded.

The intermediate layer has a JIS-C hardness of 75 to 95, preferably 85 to 95. When the hardness is higher than 95, the shot feel is hard and poor. On the other hand, when the hardness is lower than 75, the area contacted with a golf club is large, and the spin amount is large. Therefore the golf ball creates blow-up trajectory, which reduces the flight distance. The term "hardness of the intermediate layer" as used herein refers to the surface hardness of the molded article, which is obtained by covering the center 1 with the intermediate layer 2.

It is desired that a specific gravity of the intermediate layer 2 be higher than that of the center 1 by 0.05 to 0.2, preferably 0.05 to 0.15, more preferably 0.06 to 0.11. The specific gravity of the intermediate layer 2 is higher than that of the center 1 in order to obtain two technical effects. One is the technical effect of improving the flight distance accomplished by placing a weight at outer portion of the golf ball as possible to increase the moment of inertia, and by decreasing the spin amount at the time of hitting and retaining the spin amount thereafter. The other is the technical effect of improving the rebound characteristics of the golf ball accomplished by increasing the rubber content in the center. When the specific gravity difference is smaller 15 than 0.05, the technical effect of improving the flight distance accomplished by increasing the moment of inertia is not sufficiently obtained. On the other hand, when the difference is larger than 0.2, the amount of the filler in the intermediate layer is large and the rubber content in the golf ball is small, which degrades the rebound characteristics of the resulting golf ball.

It is desired that the intermediate layer 2 of the golf ball of the present invention have a thickness of 1.0 to 2.0 mm, preferably 1.3 to 1.8 mm. When the thickness is smaller than 1.0 mm, the deformation amount of the golf ball at the time of hitting is small and the launch angle is small, which reduces the flight distance. On the other hand, when the thickness is larger than 2.0 mm, the golf ball deforms only at a portion contacted with a club face of a golf club, and the contact area is large and the spin amount is large. Therefore the golf ball creates blow-up trajectory, which reduces the flight distance. The outer layer 3 is then covered on the intermediate layer 2.

The material can be used for the outer layer 3 of the present invention includes thermoplastic resin, particularly ionomer resin, which is the same as used for the intermediate layer 2, or mixtures thereof. As the materials used in the outer layer 3 of the present invention, the above ionomer resin may be used alone, but the ionomer resin may be suitably used in combination with one or more of thermoplastic elastomer or diene block copolymer, which is the same as used for the intermediate layer 2.

The outer layer used in the present invention may optionally contain fillers (such as barium sulfate, etc.), pigments (such as titanium dioxide, etc.), and the other additives such as a dispersant, an antioxidant, a UV absorber, a photostabilizer and a fluorescent agent or a fluorescent brightener, etc., in addition to the resin component as main component, as long as the addition of the additives does not deteriorate the desired performance of the outer layer of the golf ball. The amount of the pigment is preferably 0.1 to 0.5 parts by weight, based on 100 parts by weight of the resin component for the outer layer.

In the golf ball of the present invention, it is required that a JIS-C hardness of the outer layer 3 be higher than that of the intermediate layer 2 by 5 to 15, preferably 5 to 12, more preferably 7 to 12. When the hardness difference is larger than 15, the deformation amount at the time of hitting the golf ball of the intermediate layer is smaller than that of the center, and the durability is degraded. On the other hand, when the hardness difference is larger than 5, the launch angle is small, which reduces the flight distance. The hardness of the outer layer is higher than that of intermediate layer in order to increase the launch angle and improve the flight distance, by adjusting the structure of the golf ball to the hardness distribution that the outer portion is harder and the inner portion is softer.

It is desired that the JIS-C hardness of the outer layer 3 be 95 to 100, preferably 97 to 100. When the hardness of the outer layer is lower than 95, the rebound characteristics are degraded and the spin amount at the time of hitting is large, which reduces the flight distance. The term hardness of the outer layer" as used herein refers to the surface hardness of the outer layer of the golf ball, which is obtained by covering the intermediate layer 2 formed on the center 1 with the outer layer 3.

The outer layer 3 of the golf ball of the present invention has a thickness of 1.0 to 2.0 mm, preferably 1.5 to 1.9 mm. When the thickness is smaller than 1.0 mm, the rebound characteristics are not sufficiently obtained, and the velocity of the golf ball is low. On the other hand, when the thickness is larger than 2.0 mm, the golf ball is too hard, and the launch angle is small.

A method of covering the intermediate layer with the outer layer 3 is not specifically limited, but may be the same method as used in the intermediate layer. At the time of molding the outer layer, many depressions called "dimples" may be optionally formed on the surface of the golf ball. Furthermore, paint finishing or marking with a stamp may be optionally provided after the outer layer is molded for commercial purpose. The three-piece solid golf ball of the present invention is formed, so that it has a diameter of not less than 42.67 mm and a weight of not more than 45.93 g, according to the PGA rule.

EXAMPLES

The following Examples and Comparative Examples further illustrate the present invention in detail but are not to be construed to limit the scope of the present invention.

Examples 1 to 6 and Comparative Examples 1 to 3

Production of Center

The rubber compositions for the center shown in Table 1 (Examples) and Table 2 (Comparative Examples) were mixed with a mixing roll, and then vulcanized by press-molding at the vulcanization condition shown in the same Tables to obtain spherical centers. The central point hardness A, surface hardness B, specific gravity E,and diameter of the resulting centers were measured, and the hardness difference (B−A) was calculated. The results are shown in Table 5 (Examples) and Table 6 (Comparative Examples). The test methods are described later.

TABLE 1

| Center composition | | Example No. 1 | 2 | 3 | 4 | 5 | 6 |
|---|---|---|---|---|---|---|---|
| BR18 *1 | | 100 | 100 | 100 | 100 | 100 | 100 |
| Zinc acrylate | | 25.5 | 25.5 | 27 | 25.5 | 26 | 27 |
| Zinc oxide | | 7.87 | 7.87 | 7.30 | 9.50 | 9.31 | 21.86 |
| Barium sulfate | | 10 | 10 | 10 | 10 | 10 | 10 |
| Dicumyl peroxide | | 0.6 | 0.6 | 0.6 | 0.6 | 0.6 | 0.6 |
| Diphenyl disulfide | | 1.0 | 1.0 | 1.0 | 1.0 | 1.0 | 1.0 |
| Vulcanization condition | | | | | | | |
| The first stage | Temp. (° C.) | 160 | 170 | 160 | 160 | 160 | 160 |
| | Time (min) | 26 | 26 | 26 | 26 | 26 | 26 |
| The second stage | Temp. (° C.) | — | — | — | — | — | — |
| | Time (min) | — | — | — | — | — | — |

TABLE 2

| Center composition | | Comparative Example No. 1 | 2 | 3 |
|---|---|---|---|---|
| BR18 *1 | | 100 | 100 | 100 |
| Zinc acrylate | | 25.5 | 27 | 31 |
| Zinc oxide | | 7.87 | 21.86 | 5.77 |
| Barium sulfate | | 10 | 10 | 10 |
| Dicumyl peroxide | | 0.6 | 0.6 | 0.6 |
| Diphenyl disulfide | | 1.0 | 1.0 | 1.0 |
| Vulcanization condition | | | | |
| The first stage | Temp. (° C.) | 145 | 145 | 160 |
| | Time (min) | 22 | 22 | 26 |
| The second stage | Temp. (° C.) | 165 | 165 | — |
| | Time (min) | 8 | 8 | — |

*1: High-cis Polybutadiene rubber (trade name "BR18") available from JSR Co., Ltd.

Preparation of Intermediate Layer and Outer Layer Compositions

The formulation materials shown in Table 3 (Examples) and Table 4 (Comparative Examples) were mixed using a kneading type twin-screw extruder to obtain pelletized intermediate layer and outer layer compositions. The extrusion condition was, a screw diameter of 45 mm, a screw speed of 200 rpm, and a screw L/D of 35.

The formulation materials were heated at 200 to 260° C. at the die position of the extruder.

TABLE 3

| | | Example No. 1 | 2 | 3 | 4 | 5 | 6 |
|---|---|---|---|---|---|---|---|
| Intermediate layer composition | | | | | | | |
| Surlyn 9945 | *2 | 35 | 35 | 35 | 40 | 40 | 40 |
| Surlyn 8945 | *3 | 35 | 35 | 35 | 40 | 40 | 40 |
| Hi-milan 1605 | *4 | — | — | — | — | — | — |
| Septon HG-252 | *5 | — | — | 30 | — | 20 | 20 |
| Hytrel 4047 | *6 | 30 | 30 | — | — | — | — |
| Pebax 2533 | *7 | — | — | — | 20 | — | — |
| Tungsten | | 31.7 | 31.7 | 36.9 | 31.6 | 36.9 | — |
| Outer layer composition | | | | | | | |

TABLE 3-continued

| | | Example No. | | | | | |
|---|---|---|---|---|---|---|---|
| | | 1 | 2 | 3 | 4 | 5 | 6 |
| Hi-milan 1605 | *4 | 60 | 60 | 60 | 60 | 60 | 60 |
| Surlyn 9945 | *2 | 40 | 40 | 40 | 40 | 40 | 40 |
| Surlyn 8945 | *3 | — | — | — | — | — | — |
| Hi-milan 1855 | *8 | — | — | — | — | — | — |
| Pebax 2533 | *7 | — | — | — | — | — | — |
| Epofriend A1010 | *9 | — | — | — | — | — | — |
| Titanium dioxide | | 3.0 | 3.0 | 3.0 | 3.0 | 3.0 | 3.0 |
| Barium sulfate | | 1.0 | 1.0 | 1.0 | 1.0 | 1.0 | 1.0 |
| Antioxidant | *10 | 0.2 | 0.2 | 0.2 | 0.2 | 0.2 | 0.2 |

TABLE 4

| | | Comparative Example No. | | |
|---|---|---|---|---|
| | | 1 | 2 | 3 |
| Intermediate layer composition | | | | |
| Surlyn 9945 | *2 | 40 | 30 | 40 |
| Surlyn 8945 | *3 | 40 | 30 | — |
| Hi-milan 1605 | *4 | — | — | 60 |
| Septon HG-252 | *5 | 20 | 40 | — |
| Hytrel 4047 | *6 | — | — | — |
| Pebax 2533 | *7 | — | — | — |
| Tungsten | | 36.1 | — | 36.9 |
| Outer layer composition | | | | |
| Hi-milan 1605 | *4 | 60 | 60 | — |
| Surlyn 9945 | *2 | 40 | 40 | 37 |
| Surlyn 8945 | *3 | — | — | 46 |
| Hi-milan 1855 | *8 | — | — | 10 |
| Pebax 2533 | *7 | — | — | 5 |
| Epofriend A1010 | *9 | — | — | 2 |
| Titanium dioxide | | 3.0 | 3.0 | 0.2 |
| Barium sulfate | | 1.0 | 1.0 | 0.2 |
| Antioxidant | *10 | 0.2 | 0.2 | 0.02 |

*2: Surlyn 9945 (trade name), ethylene-methacrylic acid copolymer ionomer resin obtained by neutralizing with zinc ion, manufactured by DuPont Co.
*3: Surlyn 8945 (trade name), ethylene-methacrylic acid copolymer ionomer resin obtained by neutralizing with sodium ion, manufactured by DuPont Co.
*4: Hi-milan 1605 (trade name), ethylene-methacrylic acid copolymer ionomer resin obtained by neutralizing with sodium ion, manufactured by Mitsui Du Pont Polychemical Co., Ltd.
*5: Septon HG-252 (trade name), hydrogenated styrene-isoprene-styrene (SIS) block copolymer having a terminal OH group, manufactured by Kuraray Co. Ltd.
*6: Hytrel 4047 (trade name), polyester thermoplastic elastomer available from Toray-Do Pont Co., Ltd.
*7: Pebax 2533 (trade name), polyamide thermoplastic elastomer, manufactured by ELF Atochem Co.
*8: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.
*9: Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight
*11: Sanol LS770 (trade name), antioxidant manufactured by Sankyo Co., Ltd.

Formation of Intermediate Layer

The compositions for the intermediate layer were injection molded on the center to form the intermediate layer. The hardness C, specific gravity F and thickness of the intermediate layer were measured, and the hardness difference (B−C) and specific gravity difference (F−E) were calculated. The results are shown in Table 5 (Examples) and Table 6 (Comparative Examples).

Production of Golf Ball

The compositions for the outer layer were covered on the intermediate layer by injection molding to form the outer layer. The hardness D, specific gravity and thickness of the resulting outer layer were measured, and the hardness difference (D−C) was calculated. The results are shown in Table 5 (Examples) and Table 6 (Comparative Examples). Then, deflashing, surface pretreatment for painting, paint and the like, which are generally done on the surface of a golf ball, were conducted on the surface to produce a golf ball having a diameter of 42.7 mm. With respect to the resulting golf balls, the flight performance, shot feel and durability were evaluated. The results are shown in Table 5 (Examples) and Table 6 (Comparative Examples). As the flight performance, launch angle when hitting by a driver and No. 5 iron club, spin amount and flight distance (carry) were measured. The test methods are as follows.

Test Method (1) JIS-C Hardness

The JIS-C hardness was measured with a JIS-C hardness meter according to JIS K 6301.

(2) Flight Performance (i) Flight Performance 1

A No. 1 wood club (W#1, a driver) having a metal head was mounted to a swing robot manufactured by True Temper Co. and the golf ball was hit at a head speed of 35 m/sec, the launch angle, flight distance and spin amount were measured. As the flight distance, carry that is a distance to the dropping point of the hit golf ball was measured. The spin amount was measured by continuously taking a photograph of a mark provided on the hit golf ball using a high-speed camera. The measurement was conducted by using 12 golf balls for every sample (n=12), and the average is shown as the result of the golf ball.

(ii) Flight Performance 2

A No. 5 iron club (I#5) was mounted to a swing robot manufactured by True Temper Co. and the golf ball was hit at a head speed of 30 m/sec, the launch angle, flight distance and spin amount were measured. As the flight distance, carry that is a distance to the dropping point of the hit golf ball was measured. The spin amount was measured by continuously taking a photograph of a mark provided on the hit golf ball using a high-speed camera. The measurement was conducted by using 12 golf balls for every sample (n=12), and the average is shown as the result of the golf ball.

(2) Shot Feel

The shot feel of the golf ball is totally evaluated by 10 golfers according to a practical hitting test using a No. 1 wood club having a metal head and No. 5 iron club. The evaluation criteria are as follows.

Evaluation Criteria:

○: The golfers felt that the golf ball has small impact force and good rebound characteristics, and shot feel is good.

Δ: The golfers felt that the golf ball has fairly good shot feel.

xW: The golfers felt that the golf ball has large impact force, and heavy and poor shot feel.

xH: The golfers felt that the golf ball has large impact force and poor rebound characteristics, and the shot feel is poor.

TABLE 5

| | Example No. | | | | | |
|---|---|---|---|---|---|---|
| | 1 | 2 | 3 | 4 | 5 | 6 |
| (Center) | | | | | | |
| JIS-C hardness | | | | | | |
| Central point hardness (A) | 59 | 55 | 62 | 59 | 64 | 63 |
| Surface hardness (B) | 72 | 73 | 75 | 72 | 74 | 75 |
| Hardness difference (B–A) | 13 | 18 | 13 | 13 | 10 | 12 |
| Specific gravity (E) | 1.13 | 1.13 | 1.13 | 1.14 | 1.14 | 1.22 |
| Diameter (mm) | 36.4 | 36.4 | 36.4 | 36.4 | 36.4 | 36.4 |
| (Intermediate layer) | | | | | | |
| Hardness (C) (JIS-C) | 90 | 90 | 85 | 90 | 88 | 88 |
| Hardness difference (B–C) | 18 | 17 | 10 | 18 | 14 | 13 |
| Specific gravity (F) | 1.24 | 1.24 | 1.24 | 1.20 | 1.24 | 0.94 |
| Specific gravity difference (F–E) | 0.11 | 0.11 | 0.11 | 0.06 | 0.10 | −0.28 |
| Thickness (mm) | 1.63 | 1.63 | 1.63 | 1.63 | 1.38 | 1.63 |
| (Outer layer) | | | | | | |
| Hardness (D) (JIS-C) | 97 | 97 | 97 | 97 | 97 | 97 |
| Hardness difference (D–C) | 7 | 7 | 12 | 7 | 9 | 9 |
| Specific gravity | 0.97 | 0.97 | 0.97 | 0.97 | 0.97 | 0.97 |
| Thickness (mm) | 1.55 | 1.55 | 1.55 | 1.55 | 1.78 | 1.55 |

TABLE 6

| | Comparative Example No. | | |
|---|---|---|---|
| | 1 | 2 | 3 |
| (Center) | | | |
| JIS-C hardness | | | |
| Central point hardness (A) | 67 | 72 | 69 |
| Surface hardness (B) | 69 | 73 | 79 |
| Hardness difference (B–A) | 2 | 1 | 10 |
| Specific gravity (E) | 1.13 | 1.22 | 1.13 |
| Diameter (mm) | 36.4 | 36.4 | 36.4 |
| (Intermediate layer) | | | |
| Hardness (C) (JIS-C) | 90 | 80 | 97 |
| Hardness difference (B–C) | 21 | 7 | 18 |
| Specific gravity (F) | 1.24 | 0.93 | 1.24 |
| Specific gravity difference (F–E) | 0.11 | −0.29 | 0.11 |
| Thickness (mm) | 1.63 | 1.63 | 1.63 |
| (Outer layer) | | | |
| Hardness (D) (JIS-C) | 97 | 97 | 91 |
| Hardness difference (D–C) | 7 | 17 | −6 |
| Specific gravity | 0.97 | 0.97 | 0.97 |
| Thickness (mm) | 1.55 | 1.55 | 1.55 |

TABLE 7

| | Example No. | | | | | |
|---|---|---|---|---|---|---|
| | 1 | 2 | 3 | 4 | 5 | 6 |
| (Golf ball) | | | | | | |
| Flight performance 1 (W#1, 35 m/sec) | | | | | | |

TABLE 7-continued

| | Example No. | | | | | |
|---|---|---|---|---|---|---|
| | 1 | 2 | 3 | 4 | 5 | 6 |
| Launch angle (degree) | 15.2 | 15.2 | 15.1 | 15.1 | 14.8 | 14.9 |
| Spin amount (rpm) | 2760 | 2730 | 2800 | 2800 | 2700 | 2810 |
| Carry (yard) | 168.6 | 168.6 | 168.0 | 168.2 | 168.0 | 167.8 |
| Flight performance 2 (I#5, 30 m/sec) | | | | | | |
| Launch angle (degree) | 17.6 | 17.8 | 16.8 | 17.6 | 17.1 | 17.3 |
| Spin amount (rpm) | 3420 | 3400 | 3520 | 3480 | 3380 | 3570 |
| Carry (yard) | 132.5 | 132.7 | 131.3 | 132.1 | 131.9 | 131.0 |
| Shot feel | ○ | ○ | ○ | ○ | ○ | ○ |
| Durability | ○ | ○ | ○ | ○ | ○ | ○ |

TABLE 8

| | Comparative Example No. | | |
|---|---|---|---|
| | 1 | 2 | 3 |
| (Golf ball) | | | |
| Flight performance 1 (W#1, 35 m/sec) | | | |
| Launch angle (degree) | 14.7 | 14.7 | 14.6 |
| Spin amount (rpm) | 2800 | 2850 | 2870 |
| Carry (yard) | 167.5 | 167.0 | 166.5 |
| Flight performance 2 (I#5, 30 m/sec) | | | |
| Launch angle (degree) | 16.7 | 16.2 | 16.0 |
| Spin amount (rpm) | 3490 | 3620 | 3700 |
| Carry (yard) | 130.5 | 129.9 | 128.7 |
| Shot feel | xW | Δ | xH |
| Durability | x | ○ | ○ |

As is apparent from Tables 5 to 8, the three-piece solid golf balls of Examples 1 to 6 of the present invention had longer flight distance when hit by a driver and No. 5 iron club and better shot feel than the golf balls of Comparative Examples 1 to 3.

On the other hand, in the golf ball of Comparative Example 1, the launch angle is small, which reduces the flight distance, and the shot feel at the time of hitting is hard and poor, because the difference between the surface hardness and the central point hardness of the center is small. In addition, since the hardness difference between the intermediate layer and the surface of the center is large, the deformation amount at the time of hitting the golf ball of the intermediate layer is smaller than that of the center, and the durability is degraded.

In the golf ball of Comparative Example 2, the launch angle is small, which reduces the flight distance, and the shot feel at the time of hitting is hard and poor, because the difference between the surface hardness and the central point hardness of the center is small. In addition, since the hardness difference between the intermediate layer and the surface of the center is small, the launch angle is small, which reduces the flight distance. Since the specific gravity of the intermediate layer is smaller than that of the center, the moment of inertia is small, which reduces the flight distance.

In the golf ball of Comparative Example 3, since the hardness of the intermediate layer is high, the shot feel is hard and poor. Since the hardness of the outer layer is low, the spin amount is large, which reduces the flight distance. In addition, since the hardness of the outer layer is lower than that of the intermediate layer, the golf ball does not have the hardness distribution that an outer portion is harder and an inner portion is softer, and the launch angle is small, which reduces the flight distance.

What is claimed is:

1. A three-piece solid golf ball comprising a center, an intermediate layer formed on the center, and an outer layer covering the intermediate layer, wherein the center has a central point hardness in Jis-C hardness of 55 to 75 and a surface hardness in JIS-C hardness of 65 to 85, the surface hardness is higher than the central point hardness by 10 to 20, a JIS-C hardness of the intermediate layer is higher than the surface hardness of the center by 10 to 20, and a JIS-C hardness of the outer layer is higher than the hardness of the intermediate layer by 5 to 15, wherein the outer layer has a JIS-C hardness of 97 to 100.

2. The golf ball according to claim 1, wherein the JIS-C hardness of the intermediate layer is higher than the surface hardness of the center by 14 to 18.

3. The golf ball according to claim 1, wherein a specific gravity of the intermediate layer is higher than that of the center by 0.05 to 0.2.

4. The golf ball according to claim 1, wherein the intermediate layer is mainly formed from ionomer resin.

5. The golf ball according to claim 1, wherein the intermediate layer and the outer layer each have a thickness of 1.0 to 2.0 mm.

6. A three-piece solid golf ball comprising a center, an intermediate layer formed on the center, and an outer layer covering the intermediate layer, wherein the center has a central point hardness in JIS-C hardness of 55 to 75 and a surface hardness in JIS-C hardness of 65 to 85, the surface hardness is higher than the central point hardness by 10 to 20, a JIS-C hardness of the intermediate layer is higher than the surface hardness of the center by 10 to 20, and a JIS-C hardness of the outer layer is higher than the hardness of the intermediate layer by 5 to 15, wherein the outer layer has a JIS-C hardness of 95 to 100.

7. The golf ball according to claim 6, wherein a specific gravity of the intermediate layer is higher than that of the center by 0.05 to 0.2.

8. The golf ball according to claim 6, wherein the intermediate layer is mainly formed from ionomer resin.

9. The golf ball according to claim 6, wherein the intermediate layer and the outer layer each have a thickness of 1.0 to 2.0 mm.

10. The golf ball according to claim 6, wherein the JIS-C hardness of the intermediate layer is higher than the surface hardness of the center by 14 to 18.

* * * * *